US005833270A

United States Patent [19]

Hubshman

[11] Patent Number: 5,833,270

[45] Date of Patent: Nov. 10, 1998

[54] COVER AND WALKING ATTACHMENT FOR IN-LINE SKATE WHEELS

[75] Inventor: Alexis Hubshman, New York, N.Y.

[73] Assignee: Wedgee Products, LLC, New York, N.Y.

[21] Appl. No.: 560,214

[22] Filed: Nov. 21, 1995

[51] Int. Cl.[6] ..... A63C 3/12

[52] U.S. Cl. ..... 280/825; 280/11.22

[58] Field of Search ..... 280/825, 11.22, 280/11.23, 811, 809; 36/115, 132, 134, 7.5, 15; 150/154

[56] References Cited

U.S. PATENT DOCUMENTS

| | | | |
|---|---|---|---|
| 5,236,224 | 8/1993 | Anderson et al. | 280/825 |
| 5,290,065 | 3/1994 | Kassal | 280/825 |
| 5,303,955 | 4/1994 | Zurnamer | 280/825 |
| 5,445,415 | 8/1995 | Campbell | 280/825 |
| 5,522,621 | 6/1996 | Schneider | 280/825 |

*Primary Examiner*—Richard M. Camby
*Attorney, Agent, or Firm*—Milde, Hoffberg & Macklin, LLP

[57] ABSTRACT

An in-line skate cover comprising a web, formed to surround the wheels of the skate on a bottom, front and two side portions; and a tread on said bottom portion of said web, being provided with a high stiffness to resist bowing between adjacent wheels of the skate. The in-line skate has a maximum cross sectional dimension at a position above the wheels smaller than a cross sectional dimension through an axis of the wheels, further comprising an inelastic drawstring in a conduit formed on an upper edge of said web, for constricting an upper aperture of said web at said position above the wheels. An elastic strap is provided extending over a rear upper portion of a hind wheel of the in-line skate. The cover has an open rear portion, and easily accommodates skates of differing sizes. The cover is adapted to be held in wrapped condition around an anatomical body portion, to provide protection and/or support.

21 Claims, 4 Drawing Sheets

10
11
12
14
18
21
24
29

10
11
12
14
15
16
17
18
19
21
24

COVER AND WALKING ATTACHMENT FOR IN-LINE SKATE WHEELS

FIELD OF THE INVENTION

The present invention relates to the field of covers and walking attachments for in-line skates, providing traction for walking while protecting the wheels from wear.

BACKGROUND OF THE INVENTION

In-line skates have a series of coplanar wheels having low rolling friction and high axial friction properties. These in-line skates are therefore optimized for skating and are difficult to use for simple walking.

Known covers for in-line skates include a soft, compliant rubber boot, known as "Blade Blox". This device stretches to fit over the wheels, providing a rubber tread section on the bottom. The rubber boot provides an elastic covering over the wheels. The rubber boot, however, has a number of shortcomings. First, the rubber must be stretched over the wheels. The force necessary to apply the rubber boot is high and must be applied in a vertical direction. The rubber is also subject to fracture and tearing. Finally, the tread is not fully stiff along the rolling axis, and therefore may bulge between the wheels during use.

Another known cover, the Manhattan Beach Skate Co. "Skate Guard", is formed of a non-compliant fabric, which wraps around the wheel portion of the skate. The fabric is flexible, and therefore suffers from bunching between the wheels during use. This problem is remedied by providing a strap that attaches to the top cuff of the skate boot in a vertical manner thereby applying a force in a vertical direction. In addition, although this device does not require large forces to place over the skate, the lack of rigidity makes it difficult to apply the cover, especially when the skate is being worn.

DT 2,740,681 relates to an attachment device for ice skate covers, having an elastic band with clamps or inserting pins, having an adjustable point of attachment. DE 2,928,070 relates to a skate protector attachment device having an elastic band and clamping or plug in members at each end, with wide corrugated sections, adjoining the skate on the sides.

NL 8,700,519A relates to a sickle-shaped blade cover for protecting the skate blade and facilitating walking on frozen soil. The device is secured with a locking lever about the blade support. A cord with brackets may be used to carry the protector.

CH 349,910 relates to an ice skate cover having a front and rear portion held together with an elastic spring element.

U.S. Pat. No. 1,210,224 relates to a cover and walking attachment for ice skates. A shoe-shaped tread platform provides a suitable walking surface while protecting the blade. The device is held to the skate by straps.

U.S. Pat. No. 1,310,137 relates to an attachment for an ice skate attachment providing a blade protective and traction function. A toe cover and tied laces secure the attachment to the skate.

U.S. Pat. No. 3,965,586 relates to a slip-on ski boot sole cover for protecting the ski-engaging portions of the boot. Forward and rear flanges cover the toe and heel extensions of the boot. This design assumes that the cover is formed of an elastic material.

SUMMARY OF THE INVENTION

The present invention provides an in-line skate cover with two fundamental improvements over the prior designs. First, the present tread design includes a stiffening member along the tread of the cover. This stiffening member may be integral or separate from the tread itself, and preferably extends along the length of the wheelbase. The stiffening member serves two purposes. First, it resists bunching of the tread between the wheels, i.e., an arcing of the tread in to the gap between adjacent wheels, which causes an instability. Second, it provides structural integrity to the cover so that it is easily donned.

The second improvement is in the attachment mechanism, comprising an inelastic band encircling the top of the cover above the wheels. This band acts as a drawstring, which is easily tightened after the cover is over the wheels, thereby providing a horizontal tightening force.

The cover may also serve other purposes during skating, including a shin guard, knee pad or elbow pad. For this purpose, a latching mechanism is provided to link the front and rear of the cover.

In order to retain the cover prior to tightening of the inelastic band, a supplemental affixation device is provided, which may be, for example, an elastic band at the top of one end of the cover which holds over the rear wheel, with a pocket surrounding the front wheel.

The inelastic band is preferably formed of nylon or cotton web, and is held tightly by a hook and loop fastener, e.g., Velcro(R), although other fastening systems may be employed.

It is therefore an object according to the present invention to provide an in-line skate cover comprising a web, formed to surround the wheels of the skate on a bottom, front and two side portions; and a tread on said bottom portion of said web, being provided or reinforced with a high stiffness to resist bowing between adjacent wheels of the skate.

It is a further object according to the present invention to provide an in-line skate cover wherein the in-line skate has a maximum cross sectional dimension at a position above the wheels smaller than a cross sectional dimension through an axis of the wheels, further comprising a preferably inelastic drawstring on an upper edge of said web, for constricting an upper aperture of said web at said position above the wheels. The drawstring which may be a band, string or other elongate element, is preferably provided in a canal conduit formed near an upper edge of said web.

It is a still further object according to the present invention to provide an in-line skate cover further comprising means for attachment to the skate. The attachment means may be a hook-and-loop fastener system for attaching said cover to the in-line skate. The drawstring may be tensioned by a hook and loop fastener system or a mechanical latch. A drawstring under tension may encompass the periphery of the wheel carriage to hold the cover.

According to the present invention, a strap may be provided extending over a rear upper portion of the so-called "wheel chassis" at the bottom portion of the in-line skate, to temporarily hold the cover in place while an inelastic element is tensioned to securely fasten the cover. The strap is preferably elastic.

The cover may include means for linking said front portion with a rear portion of said skate cover, which is preferably a hooked latch and a loop. This allows the cover to encircle an anatomical body part, such as a shin, knee or elbow, and can provide support and/or protection. A patch of loop material may be provided on a side portion of said web with a patch hook portion material extending from a drawstring, adapted for placement on said loop portion and to apply tension to said drawstring.

The in-line skate cover according to the present invention wherein the said web fits over skates having a variety of sizes. Thus, a rear portion of the cover is preferably open, to allow a variable-sized portion of the wheel carriage (e.g., the brake pad) to extend from the cover.

It is an object to the present invention to provide an in-line skate cover wherein the tread comprises a tractive portion and a separate or integrated stiffening portion. Thus, the tractive portion may be formed of a rubber or medium durometer elastomer, providing traction and wear resistance. A separate stiff plastic or metal element is placed parallel to the tractive portion inside the cover. For example, a sheath may be provided for the stiff member, inside the cover.

The cover is preferably formed of nylon or cotton.

The in-line skate cover preferably has a self supporting structure such said two side portions of said web extend generally upward from the tread when placed on a horizontal surface.

The tread preferably comprises a tractive portion molded or sewn onto said web.

The cover is preferably adapted to be held in wrapped condition around an anatomical body portion, and can provide protection and/or support.

It is therefore another object according to the present invention to provide an in-line skate cover comprising a stiff lower tractive portion, for placement under the wheels of the skate, and resisting bowing between the wheels during walking; an elastic member provided for loosely holding said stiff lower tractive portion to the skate; and an inelastic member provided for firmly holding said stiff lower tractive portion to the skate, said inelastic member facilitating attachment of said elastic member.

It is a still further object according to the present invention to provide a cover for an in-line skate having a boot and a carriage having plurality of wheels arranged sequentially along an axis suspended below the boot, comprising a flexible web, adapted for enveloping a bottom and two side portions of the carriage and having an upper aperture; a stiff tread on said bottom portion, having sufficient stiffness to resist bowing of said tread between adjacent wheels of said carriage; and an inelastic member extending about said aperture of said web for restricting said aperture to securely hold said cover to the in-line skate.

BRIEF DESCRIPTION OF THE DRAWINGS

The detailed description of the preferred embodiment will be described by way of drawings, in which.

DETAILED DESCRIPTION OF THE PREFERRED EMBODIMENT

Figure 2:
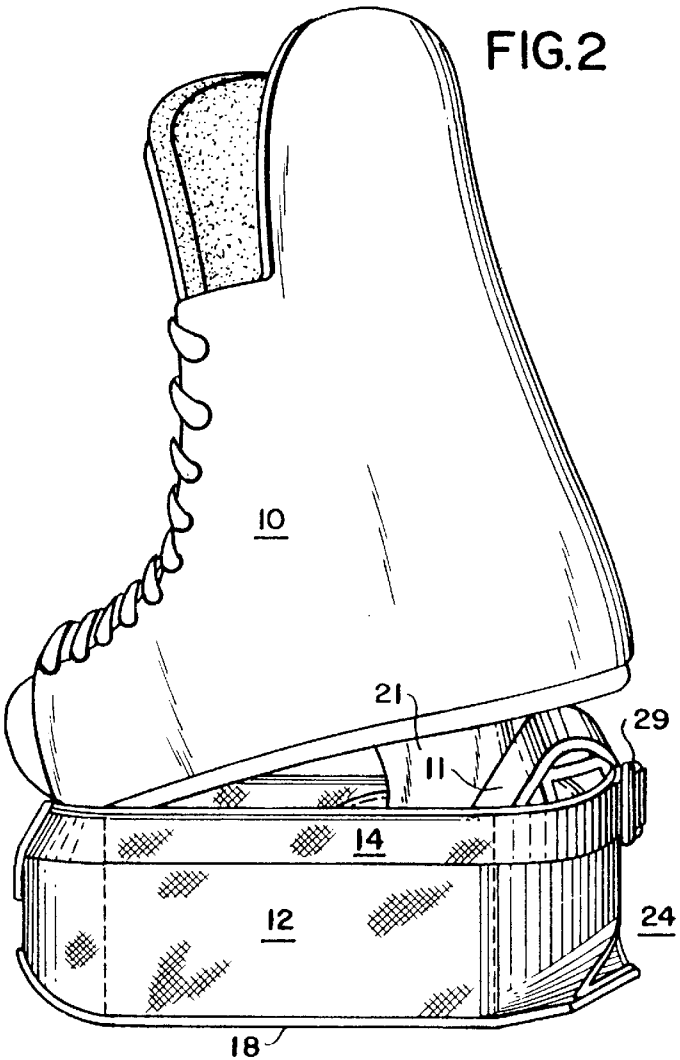
FIG. 2 is a rear perspective view of the cover according to FIG. 1 on a skate.

The preferred embodiments and the best mode for practicing the present invention will now be described with reference to the Figures. Identical elements in the various figures have been assigned the same reference numerals.

Figure 1:
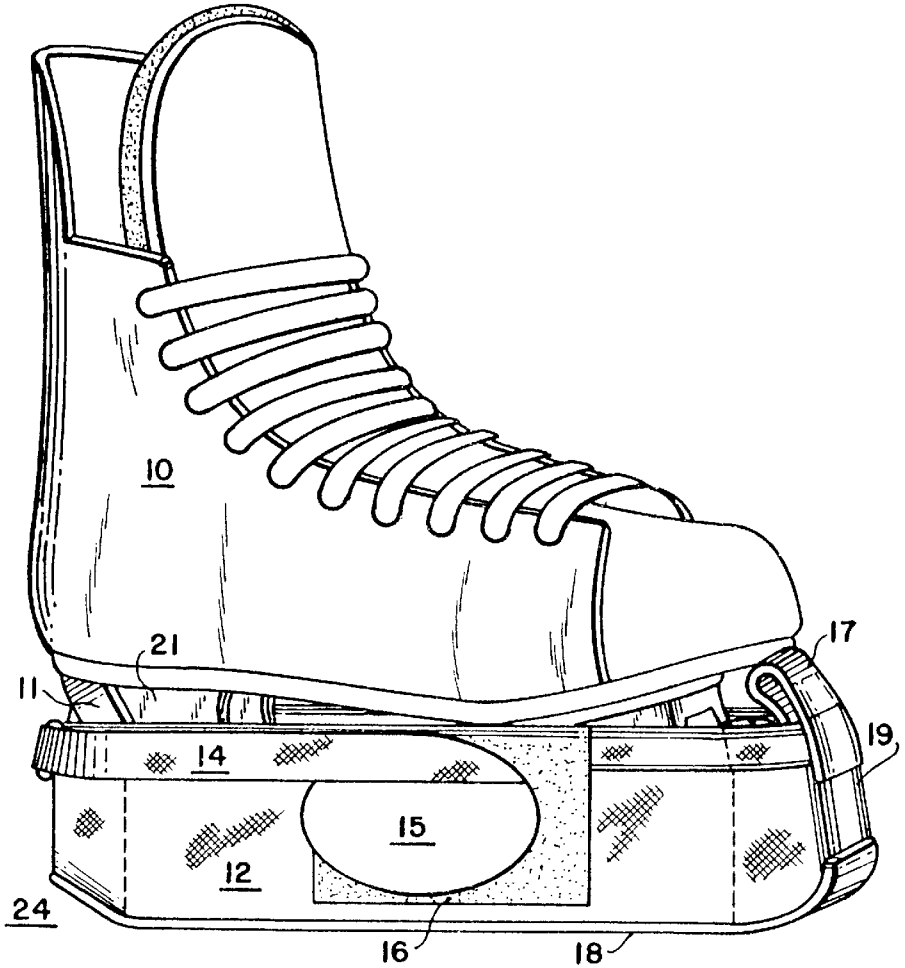
FIG. 1 is a front perspective view of the cover according to the present invention on a skate.
Figure 4A:
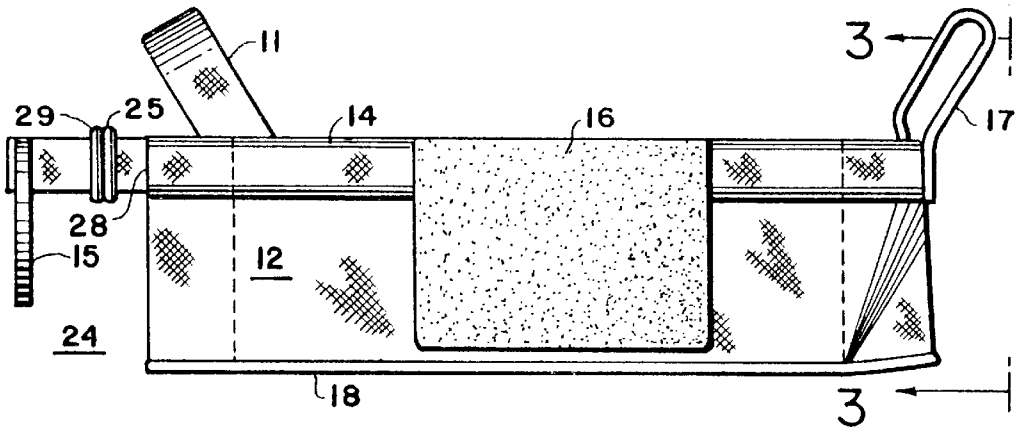
FIGS. 4A and 4B are first and second side views, respectively, of the cover according to FIG. 1.
Figure 3:
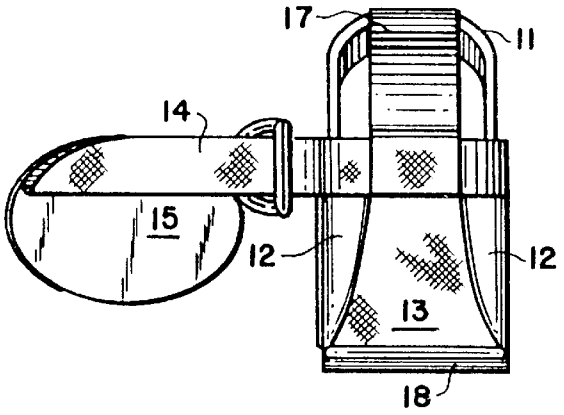
FIG. 3 is a front view of the cover according to FIG. 1.
Figure 5:
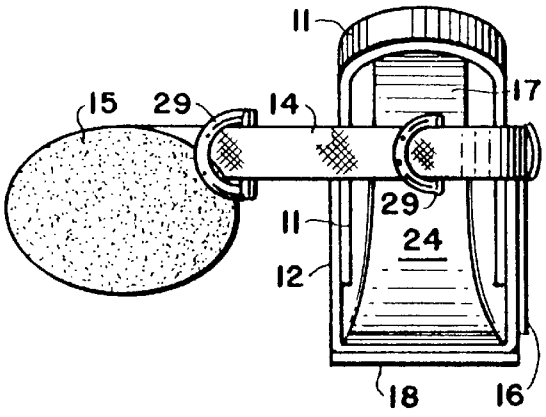
FIG. 5 is a rear view of the cover according to FIG. 1.
Figure 4B:
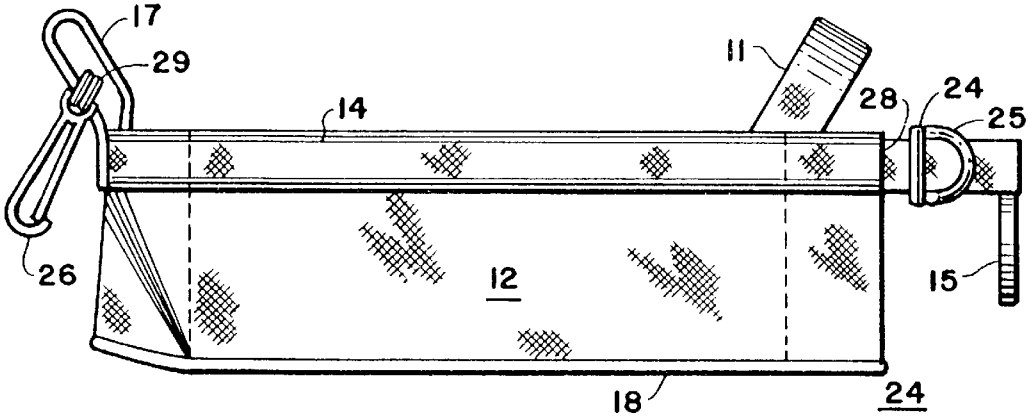
Figure 6:
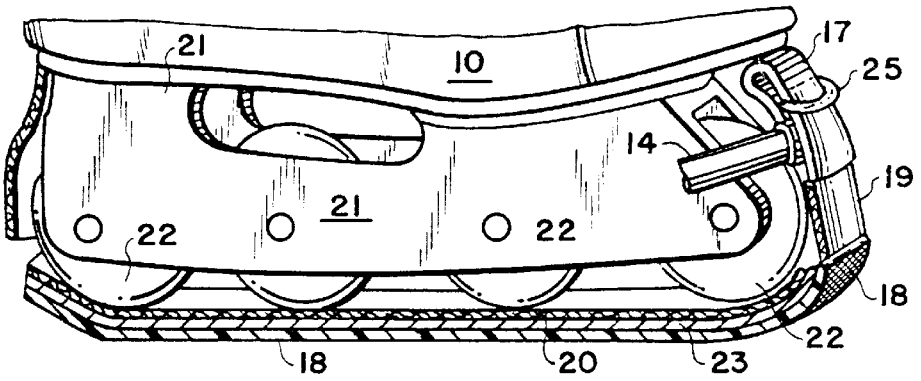
FIG. 6 is a front perspective cut-away view of the cover according to FIG. 1 on a skate.
Figure 7:
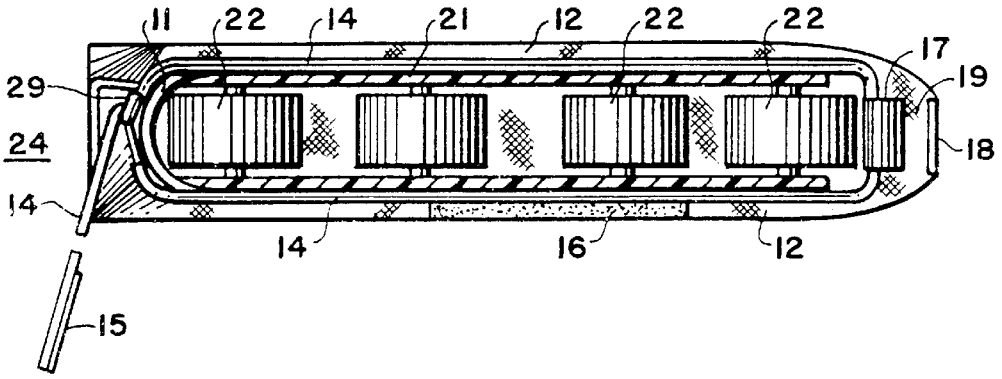
FIG. 7 is a top view of the cover according to FIG. 1 with skate wheels shown.
Figure 8:
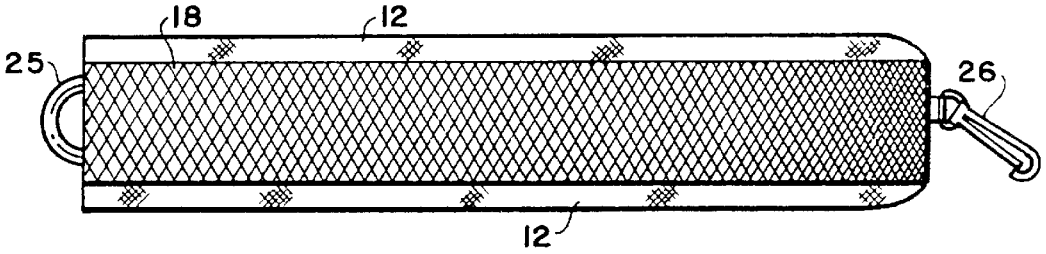
FIG. 8 is a bottom view of the cover according to FIG. 1.
Figure 9:
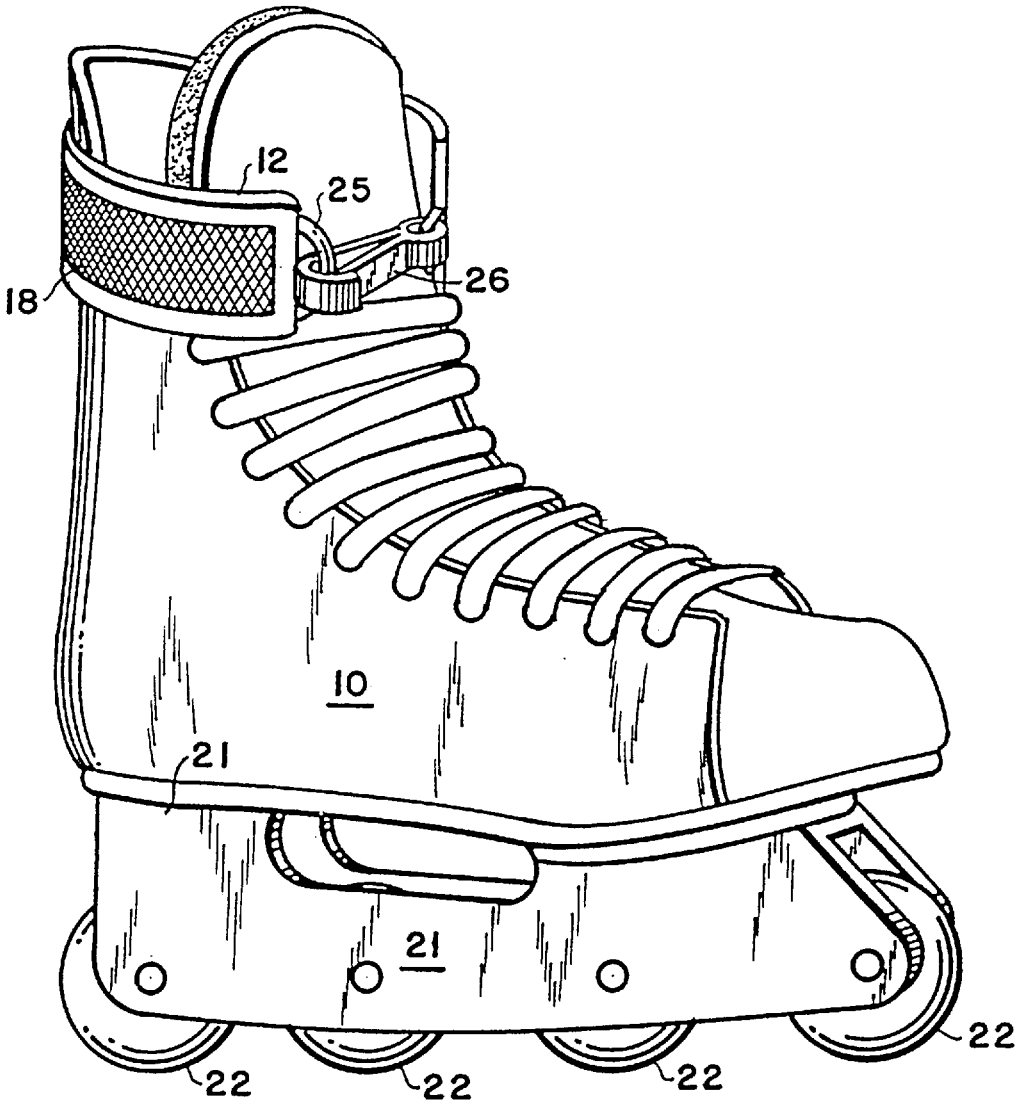
FIG. 9 is a front perspective view of a skate with a cover, according to the present invention, wrapped around the ankle portion.

As shown in FIGS. 1 to 9, a cover is provided to envelope the wheels 22 and carriage 21 of an in-line skate 10. A web material, preferably formed of a nylon or cotton cloth, is provided to form a pocket having a front 19, bottom 23 and two sides 12, with an aperture at the top. The rear 24 is open to accommodate in-line wheel chassis 21 having differing lengths.

The bottom 23 of the cover has a tread portion 18, providing a durable frictional surface serving as a sole. This tread portion 18 is therefore preferably a medium durometer elastomer, which is adhered, sewn or fused to the cloth web of the bottom 23 of the cover. The tread portion 18 is reinforced with a stiffening element 20, in order to prevent or resist bowing of the tread portion 18 between adjacent wheels 22. This is provided as a length of stiff thermoplastic sheet, extending substantially the length of the tread portion 18, in a sheath accessible from the interior of the cover. The stiffening element 20 is therefore replaceable, if necessary. It is noted that, while the stiffening element 20 resists bowing of the tread, it preferably does not prevent flexion of the cover to abut the front 19 and rear 24 portions of the cover.

The cover may serve a second purpose. When wrapped around a shin, elbow or knee, the cover may protect the anatomical portion from injury or provide added support. Thus, a hook or latch 26 (show n in FIG. 4B) and ring 25 (shown in FIGS. 4B and 6) are provided for linking the front 19 and rear 24 portions of the cover. The ring 25 is preferably located at the front portion 19 and the latch or ring 26 at the rear portion 24.

The cover is preferably sewn into a pocket configuration, with sufficient body to hold the aperture 27 open while the in-line skate 10 is being inserted. The heel of the in-line skate 10 is inserted initially into the elastic strap 11. The front leading wheel of chassis 10 extends into the pocket 19 by pulling on the strap 17. An elastic strap 11 extends upward and rearward from a rear portion 24 of the cover. The elastic strap 11 is pulled over the rear wheel 22 of the in-line skate 10, to initially hold the cover in place on the in-line skate 10. An inelastic strap 14, configured as a drawstring in a conduit 28 around the upper lip of the aperture 27 of the cover, is then tensioned by drawing it tight and pressing a hook fastener portion 15 against a loop fastener portion 16 on a side 12 of the cover.

A loop of material 17 is provided at the front portion 19 of the cover to provide a handle for pulling the front portion 19 of the cover onto the in-line skate 10. A D-ring 25 is preferably sewn into the loop of material 17, for hooking to the latch 26 on the rear portion 24.

The rear portion 24 of the cover is open, allowing the rear wheel 22 or brake pad (if any) to extend, if necessary. The end of the inelastic strap 14 protrudes from each side of the cover 12. One end has a ring 29 through which the other end passes, bridging the two side portions 12 at the rear portion 24, above the rear opening. The end of the inelastic element 14 is doubled back on itself, toward the corresponding fastener portion 16 on the side portion 12 of the cover. Thus, by pulling on the inelastic element 14, the aperture 27 is narrowed, holding it around the carriage 21 below the in-line skate 10 boot and above the relatively larger wheels 22.

It should be understood that the preferred embodiments and examples described herein are for illustrative purposes only and are not to be construed as limiting the scope of the present invention, which is properly delineated only in the appended claims.

What is claimed is:

1. An in-line skate cover comprising:

a web, formed to surround the wheels of the skate on a bottom, front and two side portions; and a tread on said bottom portion of said web, being provided with a high stiffness to resist bowing between adjacent wheels of the skate, wherein the in-line skate has a maximum cross sectional dimension at a position above the wheels smaller than a cross sectional dimension through an axis of the wheels, further comprising an inelastic drawstring on an upper edge of said web, for constricting an upper aperture of said web at said position above the wheels.

2. The in-line skate cover according to claim 1, wherein said web is open in the area of the rear of the skate wheels, thereby to permit attachment over the skate wheels notwithstanding the presence of a brake member arranged on the skate behind the skate wheels.

3. The in-line skate cover according to claim 1, further comprising means for attachment to the skate.

4. The in-line skate cover according to claim 1, further comprising a hook-and-loop fastener system for attaching said cover to the in-line skate.

5. The in-line skate cover according to claim 1, wherein said drawstring is tensioned by a hook-and-loop fastener system.

6. The in-line skate cover according to claim 1, wherein said drawstring is tensioned by a mechanical latch.

7. The in-line skate cover according to claim 1, further comprising a strap extending over a rear upper portion of a hind wheel of the in-line skate.

8. The in-line skate cover according to claim 7, wherein said strap is elastic.

9. The in-line skate cover according to claim 1, further comprising means for linking said front portion with a rear portion of said skate cover.

10. The in-line skate cover according to claim 9, wherein said linking means comprises a hooked latch and a loop.

11. The in-line skate cover according to claim 1, wherein said web fits over skates having a variety of sizes.

12. The in-line skate cover according to claim 1, wherein said tread comprises a tractive portion and a separate stiffening portion.

13. The in-line skate cover according to claim 1, wherein said web is formed of a cloth selected from the group consisting of nylon and cotton.

14. The in-line skate cover according to claim 1, wherein at least a portion of said drawstring is provided in a canal conduit formed near an upper edge of said web.

15. The in-line skate cover according to claim 4, wherein a patch of loop material is provided on a side portion of said web and a patch of hook material is provided, extending from a drawstring, adapted for placement on said loop portion and to apply tension to said drawstring.

16. The in-line skate cover according to claim 1, wherein said web has a self supporting structure such that said two side portions of said web extend generally upward from the tread when placed on a horizontal surface.

17. The in-line skate cover according to claim 1 wherein said tread comprises a tractive portion molded onto said web.

18. The in-line skate cover according to claim 1, wherein said cover is adapted to be held in wrapped condition around an anatomical body portion.

19. The in-line skate cover according to claim 18, wherein said cover provides protection of said anatomical body portion.

20. An in-line skate cover comprising:

a stiff lower tractive portion, for placement under the wheels of the skate, which resists bowing between the wheels during walking;

an elastic member provided for loosely holding said stiff lower tractive portion to the skate; and an inelastic member provided for firmly holding said stiff lower tractive portion to the skate;

said elastic member facilitating attachment of said inelastic member.

21. A cover for an in-line skate having a boot and a carriage having plurality of wheels arranged sequentially along an axis suspended below the boot, comprising:

a flexible web, adapted for enveloping a bottom and two side portions of the carriage and having an upper aperture;

a stiff tread on said bottom portion, having sufficient stiffness to resist bowing of said tread between adjacent wheels of said carriage; and an inelastic member extending about said aperture of said web for restricting said aperture to securely hold said cover to the in-line skate.

* * * * *